US009659742B2

(12) United States Patent
Anno et al.

(10) Patent No.: US 9,659,742 B2
(45) Date of Patent: May 23, 2017

(54) X-RAY TUBE AND METHOD OF MANUFACTURING THE SAME

(71) Applicant: Toshiba Electron Tubes & Devices Co., Ltd., Otawara-shi (JP)

(72) Inventors: Hidero Anno, Otawara (JP); Naoki Takahashi, Nasushiobara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 180 days.

(21) Appl. No.: 14/555,940

(22) Filed: Nov. 28, 2014

(65) Prior Publication Data

US 2015/0162163 A1 Jun. 11, 2015

(30) Foreign Application Priority Data

Dec. 6, 2013 (JP) ..... 2013-252966

(51) Int. Cl.

| | |
|---|---|
| ***H01J 35/18*** | (2006.01) |
| ***H01J 9/24*** | (2006.01) |
| ***H01J 35/06*** | (2006.01) |
| ***H01J 35/08*** | (2006.01) |

(52) U.S. Cl.

CPC ..... *H01J 35/18* (2013.01); *H01J 9/24* (2013.01); *H01J 35/06* (2013.01); *H01J 35/08* (2013.01); *H01J 2235/186* (2013.01); *H01J 2235/20* (2013.01)

(58) Field of Classification Search

CPC .. H01J 35/00; H01J 35/02; H01J 35/18; H01J 35/20; H01J 2235/18; H01J 2235/183; H01J 2235/186; H01J 2235/20

USPC ..... 378/123, 140

See application file for complete search history.

(56) References Cited

U.S. PATENT DOCUMENTS

| | | | |
|---|---|---|---|
| 3,513,274 | A | 5/1970 | Jullien-Davin |
| 4,034,251 | A | 7/1977 | Haas |
| 5,949,849 | A | 9/1999 | Hirano et al. |

(Continued)

FOREIGN PATENT DOCUMENTS

| | | | |
|---|---|---|---|
| CN | 1682334 | A | 10/2005 |
| CN | 1938811 | A | 3/2007 |
| DE | 28 33 093 | A1 | 2/1980 |

(Continued)

OTHER PUBLICATIONS

Extended European Search Report issued Apr. 28, 2015 in Patent Application No. 14194485.0.

(Continued)

*Primary Examiner* — Jurie Yun

(74) *Attorney, Agent, or Firm* — Oblon, McClelland, Maier & Neustadt, L.L.P.

(57) ABSTRACT

According to one embodiment, an X-ray tube includes an envelope with an opening, an X-ray transmission assembly mounted on the envelope and vacuum-tightly blocking the opening, a cathode and an anode target. The X-ray transmission assembly includes a window frame, an X-ray transmission window, an X-ray-resistive resin film, a sealing member and a dry gas. The X-ray transmission window is formed of a beryllium thin plate, accommodated in the window frame, and configured to maintain, along with the window frame, a vacuum-tight state inside the envelope. The X-ray-resistive resin film forms a space inside along with the window frame and the X-ray transmission window. The dry gas fills the space.

20 Claims, 7 Drawing Sheets

(56) References Cited

U.S. PATENT DOCUMENTS

| | | | |
|---|---|---|---|
| 6,594,341 | B1 | 7/2003 | Lu et al. |
| 2010/0046715 | A1 | 2/2010 | Freudenberger |

FOREIGN PATENT DOCUMENTS

| | | | |
|---|---|---|---|
| GB | 928721 | | 6/1963 |
| JP | 3-35774 | | 5/1991 |
| JP | 5-142398 | | 6/1993 |
| JP | 8-315759 | A | 11/1996 |
| JP | 2935961 | | 8/1999 |
| JP | 2004-212522 | A | 7/2004 |

OTHER PUBLICATIONS

Combined Office Action and Search Report issued Jul. 6, 2016 in Chinese Patent Application No. 201410737535.7 (with English language translation).

X-RAY TUBE AND METHOD OF MANUFACTURING THE SAME

CROSS-REFERENCE TO RELATED APPLICATIONS

This application is based upon and claims the benefit of priority from Japanese Patent Application No. 2013-252966, filed Dec. 6, 2013, the entire contents of which are incorporated herein by reference.

FIELD

Embodiments described herein relate generally to an X-ray tube and a method of manufacturing the same.

BACKGROUND

Generally, X-ray tubes are employed in medical diagnostic systems, industrial diagnostic systems and the like. X-ray tubes are used for checking foreign matters or analyzing materials in the industrial field and the like. X-ray analysis is an analysis on components of various types of materials or composition of products. An X-ray tube employed in X-ray analysis comprises an anode, a cathode and an envelope. Further, in a general type of X-ray tube, a beryllium (Be) window is used as its X-ray transmission window. The Be window is a part of the envelope and transmits an X-ray beam to be used (or releases a beam to the outside).

The above-described X-ray tube for analysis has the following problems. That is, when the X-ray tube is continuously used while an outer surface of the Be window exposed to the atmosphere, the Be window itself and the brazed portion between the Be window and the envelope are corroded while in use, thereby frequently destroying the vacuum state of the envelope. Note that the Be window needs to be thinner in order to improve the accuracy of analysis, but the above-described problems, in particular, are exacerbated.

The following (1 and 2) are known as techniques for suppressing such problems.

(1) A polyimide resin-forming liquid is applied onto the outer surface of the Be window, followed by drying and baking, and thus a polyimide resin coating which is hardly deteriorated to X-rays is formed on the outer surface of the Be window.

(2) Besides resins, an inorganic coating such as of a boron compound is used as a protecting film.

DETAILED DESCRIPTION

Figure 1:
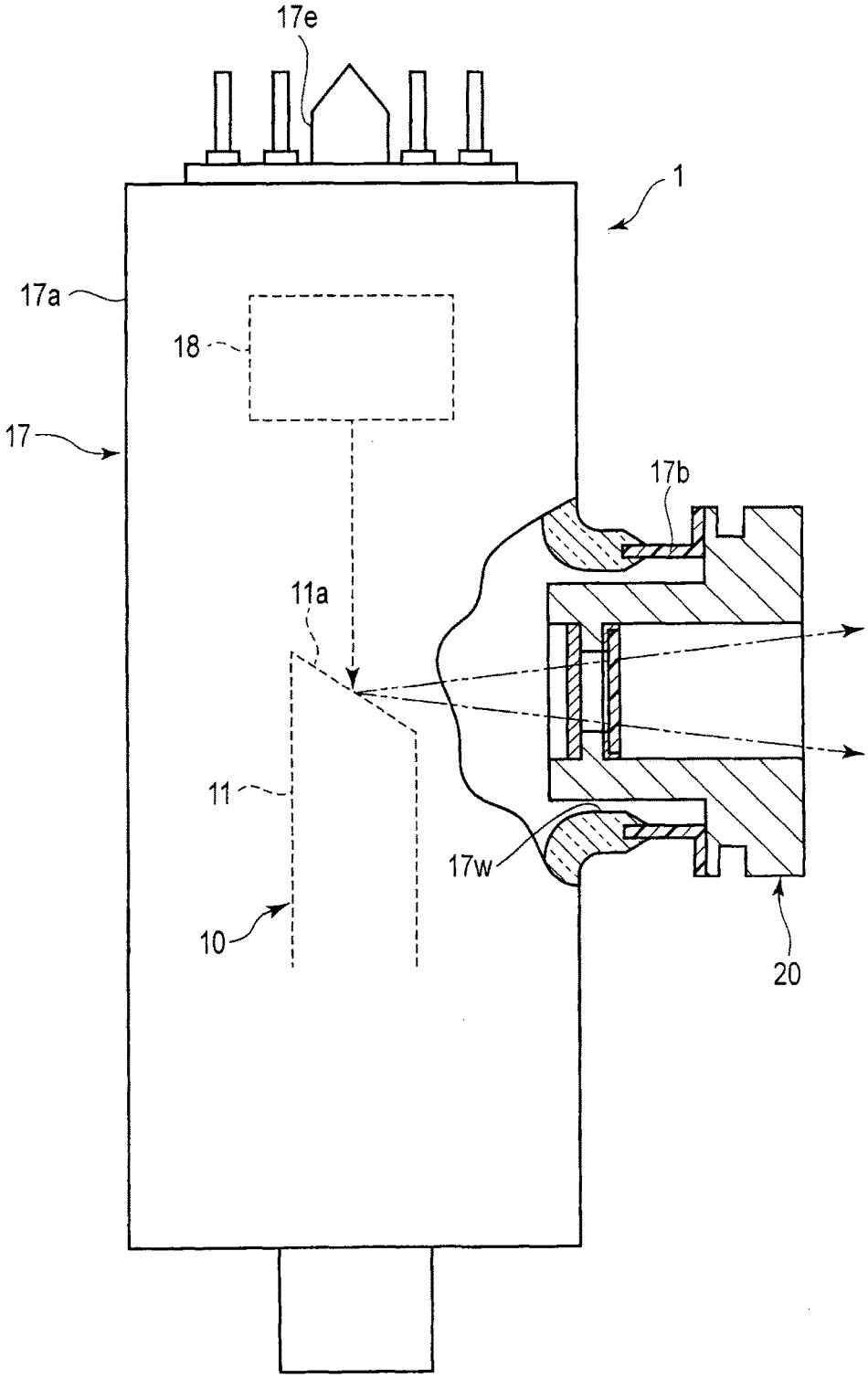
FIG. 1 is a schematic diagram briefly showing an X-ray tube of the first embodiment.

In general, according to one embodiment, there is provided an X-ray tube comprising: an envelope comprising an opening; an X-ray transmission assembly mounted on the envelope and vacuum-tightly blocking the opening; a cathode accommodated in the envelope and configured to emit electrons; and an anode target accommodated in the envelope and configured to emit X-rays, wherein the X-ray transmission assembly comprises, a window frame opposing the opening and vacuum-tightly mounted to the envelope, an X-ray transmission window formed of a beryllium thin plate, accommodated in the window frame, and configured to maintain, along with the window frame, a vacuum-tight state inside the envelope and transmit X-rays, an X-ray-resistive resin film located in the atmosphere side from the window frame, opposing the X-ray transmission window with a gap between the X-ray-resistive resin film and window frame, and configured to form a space inside along with the window frame and the X-ray transmission window, a sealing member configured to air-tightly block the gap between the window frame and the X-ray-resistive resin film to maintain an airtight state of the space, and a dry gas filled in the space.

According to another embodiment, there is provided an X-ray tube comprising: an envelope comprising an opening; an X-ray transmission assembly mounted on the envelope and vacuum-tightly blocking the opening; a cathode accommodated in the envelope and configured to emit electrons; and an anode target accommodated in the envelope and configured to emit X-rays, wherein the X-ray transmission assembly comprises, a window frame opposing the opening and vacuum-tightly mounted to the envelope, an X-ray transmission window formed of a beryllium thin plate, accommodated in the window frame, and configured to maintain, along with the window frame, a vacuum-tight state inside the envelope and transmit X-rays, an X-ray-resistive resin film located in the atmosphere side from the X-ray transmission window, opposing the X-ray transmission window with a gap between the X-ray-resistive resin film and the X-ray transmission window, a frame member opposing the opening, provided with the X-ray-resistive resin film air-tightly attached on the frame member, and configured to form a space inside along with the window frame, the X-ray transmission window and the X-ray-resistive resin film, a sealing member configured to air-tightly block the gap between the window frame and the frame member to maintain an airtight state of the space, and a dry gas filled in the space.

According to another embodiment, there is provided a method of manufacturing an X-ray tube, comprising: preparing an envelope comprising an opening, a window frame, an X-ray transmission window formed of a beryllium thin plate, to transmit X-rays, a cathode to emit electrons, an anode target to emit X-rays, and an X-ray-resistive resin film; accommodating the X-ray transmission window in the window frame; mounting the window frame onto the envelope while the window frame in which the X-ray transmission window is accommodated opposing the opening, thereby vacuum-tightly blocking the opening; accommodating the cathode and the anode target in the envelope; evacuating internal space of the envelope in which the cathode and the anode target are accommodated and to which the window frame accommodating the X-ray transmission window therein is mounted, and vacuum-tightly sealing the envelope; setting the X-ray-resistive resin film to locate an outer side of the envelope and to oppose the X-ray transmission window with a gap between the X-ray-resistive resin film and the X-ray transmission window in a dry gas atmosphere, thereby forming a space filled with a dry gas and defined by the window frame, the X-ray transmission window and the X-ray-resistive resin film; and air-tightly blocking the gap between the window frame and the X-ray-resistive resin film with a sealing member to maintain an airtight state of the space, thereby forming an X-ray transmission assembly comprising the window frame, the X-ray transmission window, the X-ray-resistive resin film, the sealing member and the dry gas.

According to another embodiment, there is provided a method of manufacturing an X-ray tube, comprising: preparing an envelope comprising an opening, a window frame, an X-ray transmission window formed of a beryllium thin plate, to transmit X-rays, a cathode to emit electrons, an anode target to emit X-rays, a frame member and an X-ray-resistive resin film; accommodating the X-ray transmission window in the window frame; mounting the window frame onto the envelope while the window frame in which the X-ray transmission window is accommodated opposing the opening, thereby vacuum-tightly blocking the opening; accommodating the cathode and the anode target in the envelope; evacuating internal space of the envelope in which the cathode and the anode target are accommodated and to which the window frame accommodating the X-ray transmission window therein is mounted, and vacuum-tightly sealing the envelope; air-tightly attaching the X-ray-resistive resin film to the frame member; setting the X-ray-resistive resin film to oppose the X-ray transmission window with a gap between the X-ray-resistive resin film and the X-ray transmission window while the frame member opposing the opening in an outer side of the envelope in a dry gas atmosphere, thereby forming a space filled with a dry gas and defined by the window frame, the X-ray transmission window, the X-ray-resistive resin film and the frame member; and air-tightly blocking the gap between the window frame and the frame member with a sealing member to maintain an airtight state of the space, thereby forming an X-ray transmission assembly comprising the window frame, the X-ray transmission window, the frame member, the X-ray-resistive resin film, the sealing member and the dry gas.

First, the basic concept of the present embodiments will now be described.

The X-ray tubes for analysis are used for elemental analysis of various materials, composition analysis of products and the like. They are used to analyze, for example, chloride-based materials, sulfide-based materials, fluoride-based materials and acids as well. But upon radiation of X-rays, corrosive gas is emitted from these materials, and it bond to moisture in the air to produce acids such as hydrochloric acid, sulfuric acid and fluoric acid, on the outer surfaces of the Be window and the brazed portion between the Be window and envelope (hereinafter referred to simply as brazed portion). It is assumed that these acids are the main factor of the above-described problems.

Another possible factor is assumed that while in use, the atmospheric air ($O_2$+$N_2$) near the outer surface of the Be window (thin plate made of beryllium (Be) transmitting X-rays) produces gaseous NO, $NO_2$ and ozone decomposed by X-ray irradiation, and these gases bond to moisture in the air to produce nitric acid and ozone water on the outer surfaces of the Be window and the brazed portion.

These acids cause corrosion of the surface of the Be window and the outer surface of the brazed portion and also progress of the corrosion as the time elapse, which eventually creates an etch pit which communicates the vacuum space and the atmosphere, destroying the vacuum state of the X-ray tube (envelope). A reason why the above-described conventional technique has been failing to obtain the effect of protecting the Be window is estimated as follows. That is, since the protective film is formed tightly on the surface of the Be window, the acids gradually penetrate the protective film on the outer surface of the Be window, and eventually reach the surface of the Be window.

The present embodiments have been proposed as a solution to the above-described drawbacks of the conventional technique, and can provide an X-ray tube which can prolong a product life cycle and has a high product reliability, and a method of manufacturing the X-ray tube. Now, outline of means and methods for solving the above problems will be described.

According to the present embodiments, an X-ray-resistive resin film of polyetheretherketone (PEEK) or polyimide (PI) is placed to be apart by a gap from the Be window, and the end portions thereof are adhered to an outer surface of the window frame (frame portion) in a dry gas atmosphere. Here, the window frame has a relatively low X-ray transmission and also located in a portion outer peripheral to the X-ray transmission area of the Be window. With this structure, a space filled with dry gas can be formed between the X-ray-resistive resin film and the Be window. The dry gas does not contain moisture, and therefore does not produce corrosive acids such as nitric acid and ozone water on the surface of the Be window unlike the ordinary atmospheric air. Further, acids produced on the outer surface of the X-ray-resistive resin film cannot penetrate and reach the Be window or the surface of the brazed portion to cause corrosion unlike the conventional techniques since the space filled with the dry gas isolates the Be window and the surface of the braze portion from the acids. In this manner, corrosion of the Be window can be prevented.

Next, the means and the methods will be described in detail.

The following are detailed descriptions of an X-ray tube and a method of manufacturing the same of the first embodiment, while referring to accompanying drawings. First, the structure of the X-ray tube will be explained.

As shown in FIG. 1, an X-ray tube 1 is a stationary anode X-ray tube. The X-ray tube 1 comprises an anode target 10, a cathode 18, an envelope 17 and an X-ray transmission assembly 20.

The anode target 10 is accommodated in the envelope 17. The anode target 10 comprises a target main body 11 and a target surface 11*a*. The target main body 11 is formed of copper. The target surface 11*a* is formed on a surface of the target main body 11 which opposes to the cathode 18. The target surface 11*a* is formed of a tungsten alloy. On the target surface 11*a*, a focal point is formed, which emits X-rays upon collision of electron thereto.

The cathode 18 is accommodated in the envelope 17. The cathode 18 is disposed away by a gap from the target surface 11*a* of the anode target 10. The cathode 18 comprises an electron emitting source (for example, filament) which emits electrons to be applied onto the anode target 10.

The envelope 17 is made of metal and glass. The envelope 17 comprises a glass envelope portion 17*a* formed of glass. The glass envelope portion 17*a* has a shape of cylinder whose both ends are blocked. The glass envelope portion 17*a* comprises an opening 17*w*. In the embodiment, the opening 17*w* is circular. The opening 17*w* is located near the target surface 11*a*, and allows X-rays to exit therefrom.

The envelope 17 comprises a metal envelope portion 17*b* formed of a metal. The metal envelope portion 17*b* is located outside the glass envelope portion 17*a* such as to surround the opening 17*w*. The metal envelope portion 17*b* is vacuum-tightly connected to the glass envelope portion 17*a*. The metal envelope portion 17*b* comprises a flange portion formed therein to join it to the X-ray transmission assembly 20. In the embodiment, the metal envelope portion 17*b* (flange portion) is formed into a circular frame shape.

The X-ray transmission assembly 20 is mounted to the metal envelope portion 17*b* (envelope 17) and thus it vacuum-tightly blocks the opening 17*w*. In this manner, the envelope 17 is vacuum-tightly closed and accommodates the anode target 10, the cathode 18 and the like. The inside of the envelope 17 is maintained in a vacuum state.

Figure 2:
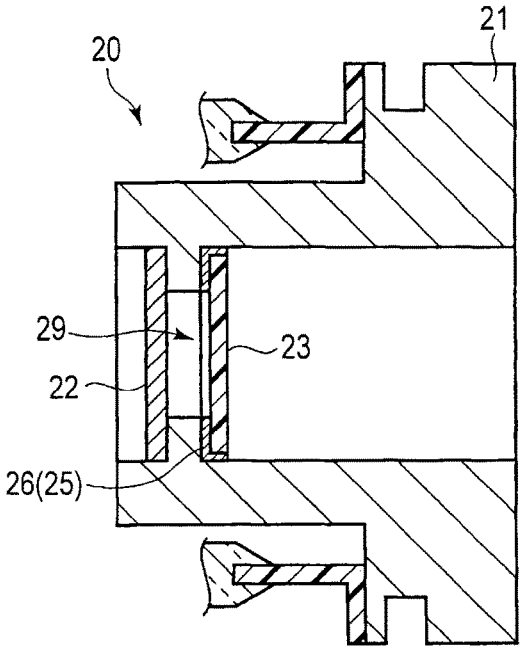
FIG. 2 is an enlarged cross-sectional view showing an X-ray transmission assembly shown in FIG. 1.
Figure 3:
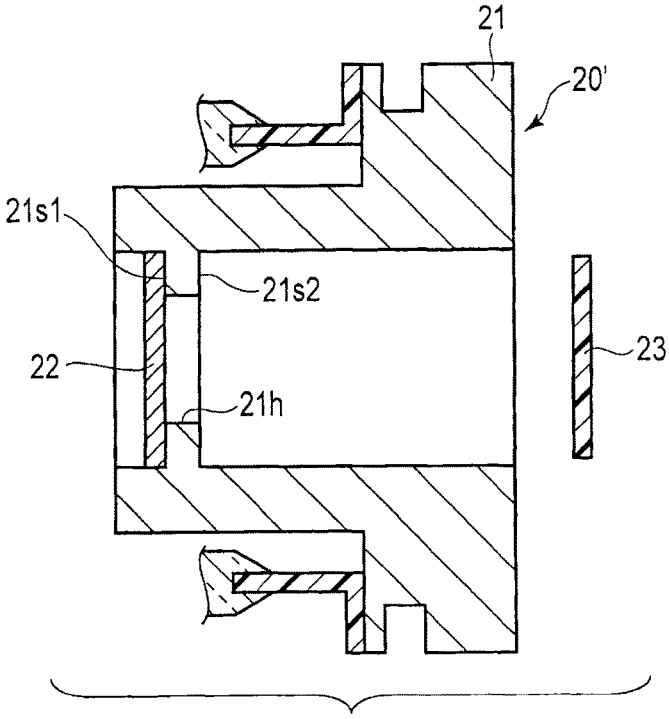
FIG. 3 is a decomposed diagram of the X-ray transmission assembly shown in FIGS. 1 and 2, illustrating a window frame, an X-ray transmission window and an X-ray-resistive resin film.

As shown in FIGS. 1, 2 and 3, the X-ray transmission assembly 20 comprises a window frame 21, an X-ray transmission window 22, an X-ray-resistive resin film 23, sealing member 25 and dry gas 29.

The window frame 21 opposes the opening 17*w*. The window frame 21 comprises a flange portion formed therein to join it to the metal envelope portion 17*b*. In the embodiment, the window frame 21 (flange portion) is formed into a circular frame shape. The window frame 21 is vacuum-tightly mounted to the metal envelope portion 17*b* (envelope 17). In the embodiment, since the flange portion of the window frame 21 is welded to the flange portion of the metal envelope portion 17*b*, the window frame 21 is vacuum-tightly mounted to the envelope 17.

The window frame 21 comprises a through-hole 21*h* which allows X-rays to exit, a first mount surface 21*s*1 and a second mount surface 21*s*2. In the embodiment, the through-hole 21*h* is circular, and the first mount surface 21*s*1 and second mount surface 21*s*2 have a circular frame shape. The first mount surface 21*s*1 and the second mount surface 21*s*2 are flat. The first mount surface 21*s*1 is formed outside the through-hole 21*h*, and located on an inner side (vacuum side) of the envelope 17. The second mount surface 21*s*2 is formed outside the through-hole 21*h*, and located on an outer side (atmosphere side) of the envelope 17.

The X-ray transmission window 22 transmits X-rays. The X-ray transmission window 22 can be made of a material which exhibits an X-ray transmitting property and a high mechanical strength. In the embodiment, the X-ray transmission window 22 is made from a Be plate (beryllium thin plate: thin plate which uses beryllium).

The X-ray transmission window 22 is located on an inner side of the envelope 17. The X-ray transmission window 22 is formed into a plate shape. In the embodiment, the X-ray transmission window 22 has a disk shape. The X-ray transmission window 22 comprises a mount region facing the first mount surface 21*s*1 and to be mounted to the window frame 21, and an X-ray transmission region opposing the through-hole 21*h*.

The mount region of the X-ray transmission window 22 is vacuum-tightly mounted to the first mount surface 21*s*1. For example, the X-ray transmission window 22 is mounted to the window frame 21 by brazing it to the first mount surface 21*s*1 using a brazing material (not shown). Thus, the X-ray transmission window 22 is fit into the window frame 21 so as to maintain the vacuum-tight state inside the envelope 17 together with the window frame 21.

The X-ray-resistive resin film 23 transmits X-rays. The X-ray-resistive resin film 23 can be made from a material which exhibits an X-ray transmitting property and an X-ray-resistive property. It is desired that the X-ray-resistive resin film 23 be formed of a material having an X-ray-resistive property higher than those of plastics of general industrial use. For example, it is desired that the X-ray-resistive resin film 23 be formed of a resin material containing at least one of polyimide (PI) and polyetheretherketone (PEEK).

As the X-ray-resistive resin film 23 formed of PEEK resin, for example, APTIV of VICTREX can be used. As the X-ray-resistive resin film 23 formed of PI resin, for example, Kapton (trademark) of DUPONT-TORE Co. Ltd. or Upilex (trademark) of Ube Industries, Ltd. can be used. In the embodiment, the X-ray-resistive resin film 23 is made of a PI resin.

The X-ray-resistive resin film 23 is located on a further outer side (atmosphere side) of the envelope 17 with respect to the X-ray transmission window 22, and oppose the X-ray transmission window 22 with a gap therebetween. The X-ray-resistive resin film 23 is formed into a plate shape. In the embodiment, the X-ray-resistive resin film 23 is formed into a disk shape. The X-ray-resistive resin film 23 comprises a mount region facing the second mount surface 21*s*2 and to be mounted to the window frame 21, and an X-ray transmission region opposing the through-hole 21*h*. The X-ray-resistive resin film 23 forms a space inside together with the window frame 21 and X-ray transmission window 22.

The sealing member 25 air-tightly blocks the gap between the window frame 21 and the X-ray-resistive resin film 23, so as to maintain the airtight state of the space. In the embodiment, the sealing member 25 comprises an adhesive joint portion 26 which uses adhesive. With the adhesive joint portion 26, the airtight state of the space can be maintained. As the adhesive, for example, an epoxy adhesive can be utilized.

The dry gas 29 is filled in the space (defined by the window frame 21, the X-ray transmission window 22 and the X-ray-resistive resin film 23). The dry gas 29 is a gas that does not contain moisture. It is desirable that the dry gas 29 be an inert gas containing at least one of nitrogen, neon, argon, krypton and xenon.

Thus, the X-ray tube 1 has the above-described structure.

Next, the method of manufacturing the X-ray tube 1 will now be described.

As shown from FIGS. 1 to 3, at the start of the manufacture of the X-ray tube 1, first, the envelope 17 comprising the glass envelope portion 17*a* in which the opening 17*w* is formed, and the metal envelope portion 17*b* is prepared. Further, the X-ray transmission assembly 20 to which the X-ray-resistive resin film 23 has not yet been mounted (hereinafter referred to X-ray transmission assembly 20') is prepared. Next, the X-ray transmission assembly 20' is mounted to the envelope 17 and the opening 17*w* is airtightly blocked. In the embodiment, the X-ray transmission assembly 20' is mounted to the envelope 17 by welding.

Next, the cathode 18 and the anode target 10 are accommodated in the envelope 17. After that, an internal space of the envelope 17 which now accommodates the cathode 18 and the anode target 10, with the X-ray transmission assembly 20' mounted thereto, is evacuated via an exhaust port 17*e* of the envelope 17. Thus, the inside of the envelope 17 can be evaluated to vacuum. Further, the exhaust port 17*e* is vacuum-tightly sealed during the evacuation. As described above, the X-ray tune 1 is completed.

When mounting the X-ray-resistive resin film 23 to the X-ray transmission assembly 20', first, the X-ray tube 1 with which evacuation is completed is prepared.

Next, the X-ray-resistive resin film 23 is set to oppose the X-ray transmission window 22 with a gap therebetween in a dry gas atmosphere, and a space filled with the dry gas 29 is formed inside the window frame 21, the X-ray transmission window 22 and the X-ray-resistive resin film 23.

Further, the gap between the window frame 21 and the X-ray-resistive resin film 23 is air-tightly blocked using the sealing member 25, thus maintaining the airtight state of the space. In the embodiment, the sealing member 25 comprises the adhesive joint portion 26. Here, the adhesive is applied on the second mount surface 21*s*2, and then the X-ray-resistive resin film 23 is adhered on the second mount surface 21*s*2 with the adhesive in the dry gas atmosphere. For example, in a glove box inside of which is filled with dry gas, the X-ray-resistive resin film 23 may be mounted to the window frame 21.

With the above-described operation, the gap between the window frame 21 and the X-ray-resistive resin film 23 can be blocked air-tightly, thereby forming the space. Thus, the X-ray transmission assembly 20 is formed (completed).

According to the X-ray tube 1 and the method of manufacturing the same, according to the first embodiment as described above, the X-ray tube 1 comprises the envelope 17 comprising the opening 17*w*, the X-ray transmission assembly 20, the cathode 18 and the anode target 10. The X-ray transmission assembly 20 is mounted to the envelope 17 and thus the opening 17*w* is vacuum-tightly blocked.

The X-ray transmission assembly 20 comprises the frame window 21, the X-ray transmission window 22, the X-ray-resistive resin film 23, the sealing member 25 and the dry gas 29. The X-ray-resistive resin film 23 is located on a further outer side with respect to the X-ray transmission window 22, while opposing thereto with a gap therebetween, thus forming the space inside together with the window frame 21 and the X-ray transmission window 22. The sealing member 25 air-tightly blocks the gap between the window frame 21 and the X-ray-resistive resin film 23, so as to maintain the airtight state of the space. The dry gas 29 is filled in the space.

The outer surface of the X-ray transmission window 22 is not exposed to the atmosphere. Further, the dry gas 29 does not contain moisture, and therefore does not produce corrosive acids such as nitric acid on the surface of the X-ray transmission window 22. In other words, upon irradiation of X-rays, corrosive acids such as nitric acid may be produced on the outer surface of the X-ray-resistive resin film 23; however the transmission window 22 is separated by the X-ray-resistive resin film 23 and the space filled with the dry gas 29 (for example, inert gas). Thus, the adverse effect due to the acids is not substantially created. In this manner, it is possible to suppress (prevent) corrosion of the X-ray transmission window 22. Further, the defect of destroying the vacuum airtight state of the envelope 17 can be suppressed (prevented).

The X-ray-resistive resin film 23 has a high film completeness and a less dispersion in film thickness, and thus exhibits a full effect of protecting the X-ray transmission window 22. Note that if the X-ray-resistive resin film 23 is a coating film obtained by a coating process, followed by drying and baking, the effect of protecting the X-ray transmission window 22 cannot be fully exhibited. This is because the space filled with the drying gas 29 cannot be formed in such a case. Further, if the X-ray-resistive resin film 23 is formed thin or porous, the X-ray transmission window 22 is corroded with acid.

When the X-ray-resistive resin film 23 has a large dispersion in film thickness, the X-ray transmission amount may as well be greatly dispersed undesirably.

Further, as described above, the X-ray-resistive resin film 23 is not a coating film, and therefore special costly equipments are not required. Therefore, in comparison with the case where the X-ray-resistive resin film 23 is a coating film, the X-ray tube 1 can be manufactured at a lower cost. The manufacturing step of mounting the X-ray-resistive resin film 23 is short, not skill-requiring and stably performed as compared to the conventional case (of coating film).

It is preferable that the X-ray-resistive resin film 23 be formed of a material having an X-ray resistance higher than those of plastics of general industrial use. This is because such a film can suppress the degradation of the X-ray-resistive resin film 23, caused by irradiation of X-rays. For this reason, it is desirable that the X-ray-resistive resin film 23 be formed of a resin material containing at least one of the PI resin and PEEK resin.

As the dry gas 29, an optimal example thereof is an inert gas containing at least one of nitrogen, neon, argon, krypton and xenon. This is because inert gases do not easily produce corrosive gas even upon irradiation of X-rays.

As described above, the X-ray tube 1 and the method of manufacturing the same can be obtained, which can prolong the product life cycle and achieve excellent reliability.

Next, an X-ray tube and a method of manufacturing the same, of the second embodiment will now be described in detail. In the embodiment, the structural members other than those which will be particularly discussed are identical to those of the first embodiment, and therefore they are designated by the same reference numbers and the detailed descriptions therefor will be omitted. Further, the method of manufacturing the X-ray tube is the same as that of the first embodiment, and therefore a detailed description therefor will be omitted.

Figure 4:
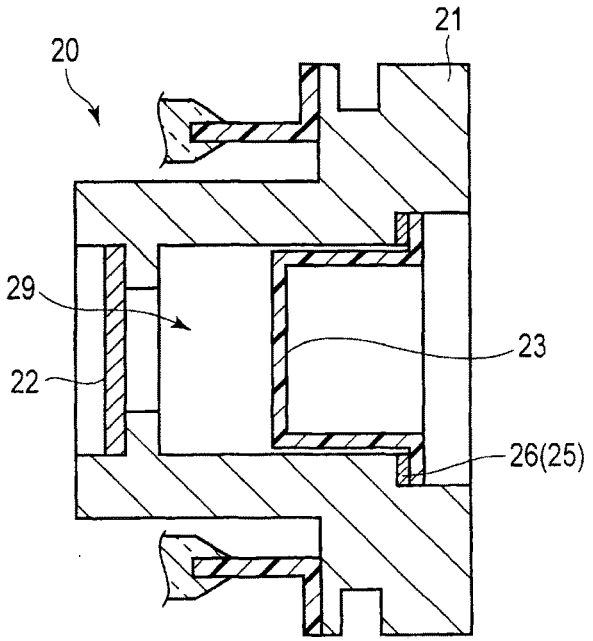
FIG. 4 is an enlarged cross-sectional view showing an X-ray transmission assembly of an X-ray tube of the second embodiment.
Figure 5:
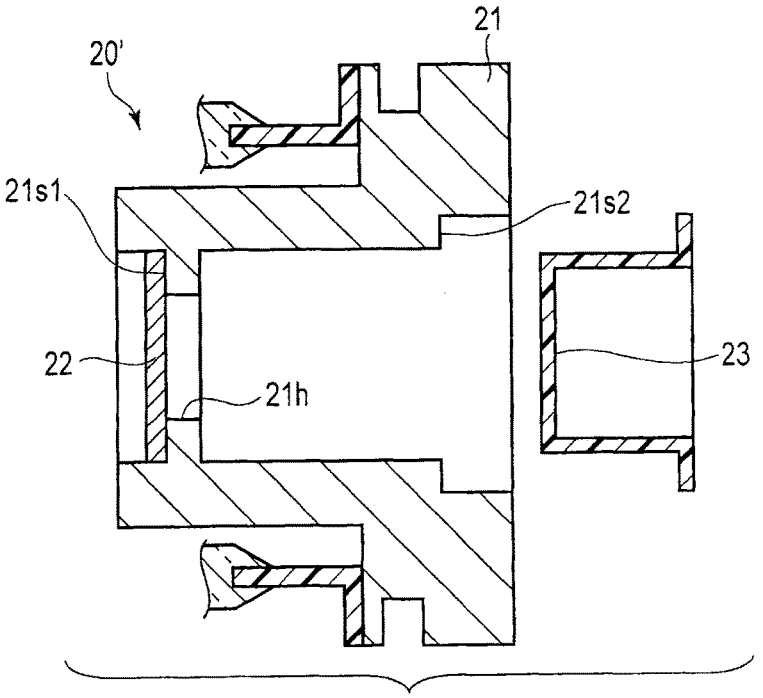
FIG. 5 is a decomposed diagram of the X-ray transmission assembly shown in FIG. 4, illustrating a window frame, an X-ray transmission window and an X-ray-resistive resin film.

As shown in FIGS. 4 and 5, an X-ray-resistive resin film 23 is formed into a tub shape. The X-ray-resistive resin film 23 is prepared by hot forming a plate-like resin film into a stereoscopic shape. A bottom side of the tub-shaped X-ray-resistive resin film 23 opposes the X-ray transmission window 22 with a gap therebetween. A window frame 21 comprises a second mount surface 21*s*2 formed thereon (positioned) such as to form a space filled with a dry gas 29.

According to the X-ray tube 1 and the method of manufacturing the same, of the second embodiment as described above, the X-ray tube 1 comprises the envelope 17 comprising the opening 17*w*, the X-ray transmission assembly 20, the cathode 18 and the anode target 10. The X-ray-resistive resin film 23 may have the stereoscopic shape, with which also an effect similar to that of the first embodiment can be obtained.

As described above, the X-ray tube 1 and the method of manufacturing the same can be obtained, which can prolong the product life cycle and achieve excellent reliability.

Next, an X-ray tube and a method of manufacturing the same, of the third embodiment will now be described in detail. In this embodiment, the structural members other than those which will be particularly discussed are identical to those of the second embodiment, and therefore they are designated by the same reference numbers and the detailed descriptions therefor will be omitted.

Figure 6:
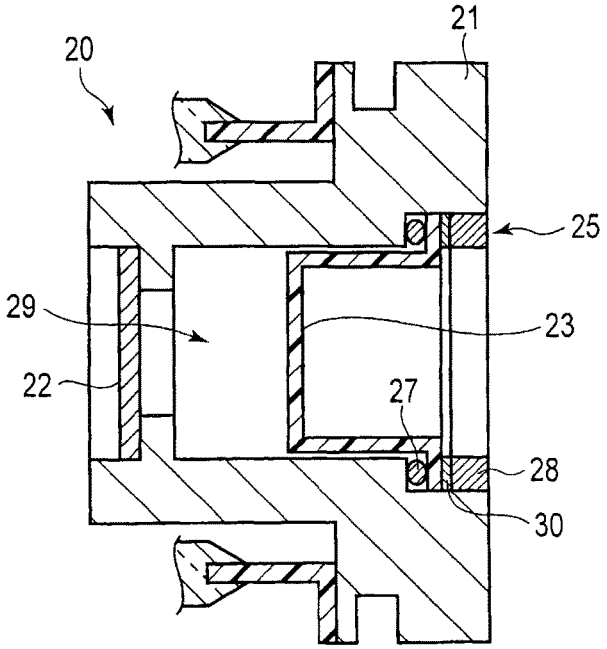
FIG. 6 is an enlarged cross-sectional view showing an X-ray transmission assembly of an X-ray tube of the third embodiment.
Figure 7:
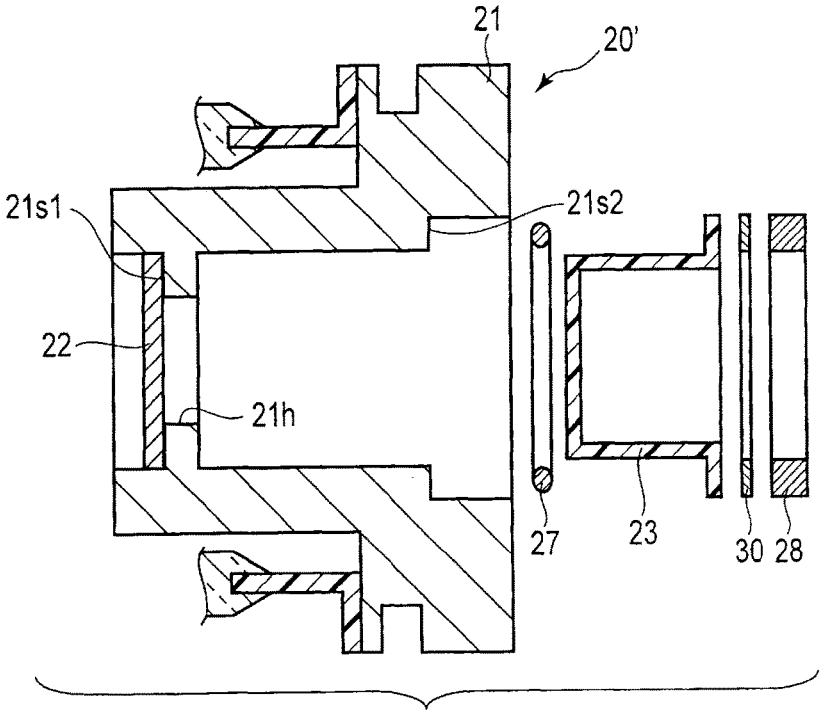
FIG. 7 is a decomposed diagram of the X-ray transmission assembly shown in FIG. 6, illustrating a window frame, an X-ray transmission window, an X-ray-resistive resin film, a rubber sealing member, a pressurization member and a spacer.

As shown in FIGS. 6 and 7, a sealing member 25 comprises a rubber seal member 27 and a pressurization member 28, in place of the adhesive joint portion 26. The rubber seal member 27 is provided between a second mount surface 21*s*2 of the window frame 21 and an X-ray-resistive resin film 23. The rubber seal member 27 is made of an O-ring of, for example, a rubber which does not easily produce corrosive gas, such as peroxide-crosslinked ethylenepropylene rubber, radiation-crosslinked fluorine rubber or phenylmethylsilicone rubber. The pressurization member 28 serves to maintain the X-ray-resistive resin film 23 pressurized on a second mount surface 21*s*2 (window frame 21) via the rubber seal member 27.

In the embodiment, the pressurization member 28 is a ring nut whose side surface is processed to have an external thread. An inner circumferential surface of the window frame 21, which corresponds to the pressurization member 28, is processed to have an internal thread. The pressurization member 28 is fastened in the inner circumferential surface of the window frame 21 to pressurize the X-ray-resistive resin film 23.

Here, the X-ray transmission assembly 20 further comprises a spacer 30. The spacer 30 interposes between a mount region of the X-ray-resistive resin film 23 and the pressurization member 28.

As described above, the rubber seal member 27 is pressurized by the second mount surface 21*s*2 and the X-ray-resistive resin film 23 (the pressurization member 28). Thus, the second mount surface 21*s*2 and the rubber seal member 27 are tightly attached to each other, and also the rubber seal member 27 and the X-ray-resistive resin film 23 are tightly attached to each other. In this manner, the space defined by the window frame 21, the X-ray transmission window 22, the X-ray-resistive resin film 23 and the rubber seal member 27 can be maintained in an airtight state.

Apart from the above, the pressurization member 28 may be mounted to the window frame 21 by being fastened and tightly fit to maintain the state of pressurizing the X-ray-resistive resin film 23.

When the rubber seal member 27 is used, the second mount surface 21*s*2 may not be flat. For example, the second mount surface 21*s*2 may comprise a frame-shaped groove formed therein, where the rubber seal member 27 can be placed.

Or when the sealing member 25 comprises the rubber seal member 27 and the pressurization member 28, the sealing member 25 may further comprise a reinforcing member (not shown). The reinforcing member serves to air-tightly block a gap between the window frame 21 and the X-ray-resistive resin film 23, thereby reinforcing the maintenance of the airtight state of the space. As the reinforcing member, adhesive, sealing agent, coating film or the like can be used. For example, a sealing agent may be applied to a space among the second mount surface 21*s*2, the inner circumferential surface of the window frame 21, and the rubber seal member 27, to form a reinforcing member of the sealing agent in a space surrounded by the second mount surface 21*s*2, the inner circumferential surface of the window frame 21, the rubber seal member 27 and the X-ray-resistive resin film 23.

Next, the method of manufacturing the X-ray tube 1 will be described. The method of manufacturing the X-ray tube 1 is roughly similar to that of the first embodiment. In the following descriptions, the manufacturing of the X-ray transmission window 22 (assembling method) will be focused.

When manufacturing an X-ray transmission assembly 20, first, an X-ray tube 1 to which an X-ray transmission assembly 20 is mounted and already subjected the vacuum process is prepared.

Next, in a dry gas atmosphere, the rubber seal member 27 is disposed on the second mount surface 21*s*2, and then the X-ray-resistive resin film 23 is set opposite to the X-ray transmission window 22 with a gap therebetween. Thus, the space filled with the dry gas 29 is formed as it is defined by the window frame 21, the X-ray transmission window 22, the X-ray-resistive resin film 23 and the rubber seal member 27.

Further, the gap between the window frame 21 and the X-ray-resistive resin film 23 is air-tightly blocked using the sealing member 25, and thus the airtight state of the space is maintained. In the embodiment, the sealing member 25 comprises the rubber seal member 27 and the pressurization member 28. With this structure, the X-ray-resistive resin film 23 can be mounted to the window frame 21 by fastening the pressurization member 28 to the inner circumferential surface of the window frame 21.

As described above, the gap between the window frame 21 and the X-ray-resistive resin film 23 can be air-tightly blocked, thereby forming the space. Thus, the manufacture of the X-ray transmission assembly 20 is completed.

According to the X-ray tube 1 and the method of manufacturing the same of the third embodiment of the above-described structure, the X-ray tube 1 comprises the envelope 17 comprising the opening 17*w*, the X-ray transmission assembly 20, the cathode 18 and the anode target 10. The sealing member 25 may comprise the rubber seal member 27 and the pressurization member 28, with which also an effect similar to that of the first embodiment can be obtained.

As described above, the X-ray tube 1 and the method of manufacturing the same can be obtained, which can prolong the product life cycle and achieve excellent reliability.

Next, an X-ray tube device and a method of manufacturing the same, of the fourth embodiment will now be described in detail. In this embodiment, the structural members other than those which will be particularly discussed are identical to those of the third embodiment, and therefore they are designated by the same reference numbers and the detailed descriptions therefor will be omitted. Further, the method of manufacturing the X-ray tube is the same as that of the third embodiment, and therefore a detailed description therefor will be omitted.

Figure 8:
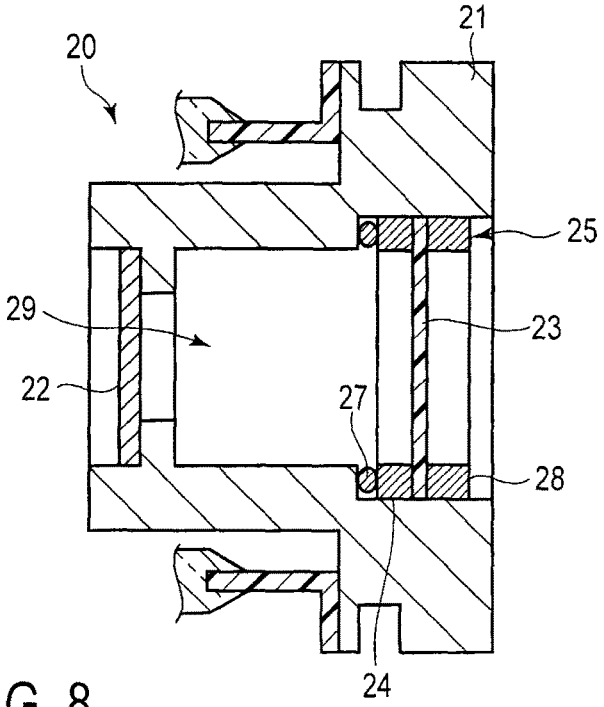
FIG. 8 is an enlarged cross-sectional view showing an X-ray transmission assembly of an X-ray tube of the fourth embodiment.
Figure 9:
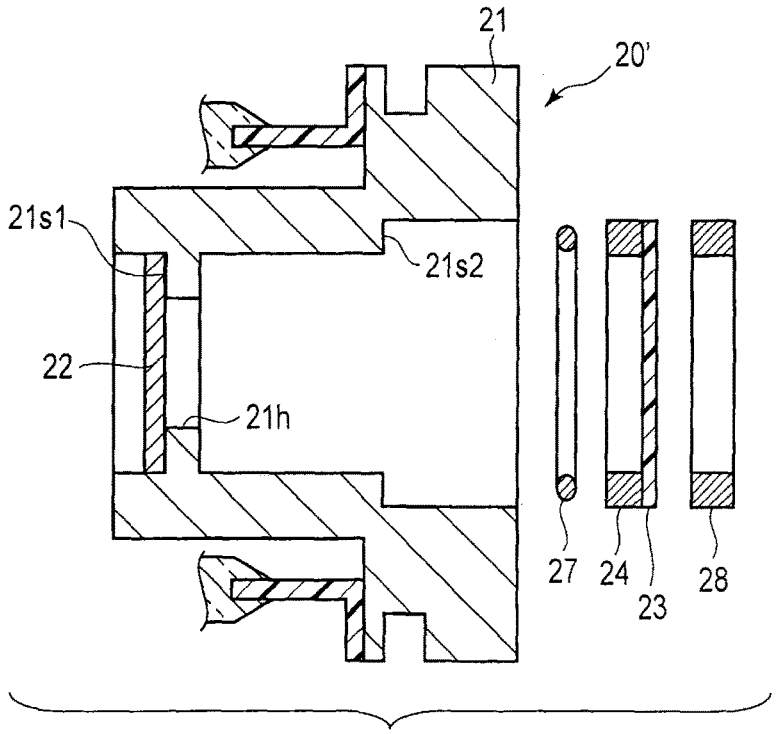
FIG. 9 is a decomposed diagram of the X-ray transmission assembly shown in FIG. 8, illustrating a window frame, an X-ray transmission window, an X-ray-resistive resin film, a frame member, a rubber sealing member and a pressurization member.

As shown in FIGS. 8 and 9, an X-ray transmission assembly 20 may further comprise a frame member 24. The frame member 24 is set to oppose an opening 17*w*. An X-ray-resistive resin film 23 is air-tightly mounted to the frame member 24. Thus, the frame member 24 forms a space inside together with a window frame 21, an X-ray transmission window 22 and the X-ray-resistive resin film 23. The frame member 24 is formed of a material having a higher rigidity than that of the X-ray-resistive resin film 23. The frame member 24 is formed of, for example, a metal. When manufacturing the X-ray transmission assembly 20, the X-ray-resistive resin film 23 is mounted in advance to the frame member 24 to form an integrated unit. In this manner, the X-ray-resistive resin film 23 can be easily handled.

A sealing member 25 (rubber seal member 27 and pressurization member 28) serves to air-tightly block a gap between the window frame 21 and the frame member 24 and maintain the airtight state of the space.

In the embodiment, the X-ray-resistive resin film 23 is formed into a disk shape.

Further, the sealing member 25 may further comprise a reinforcing member such as described above to reinforce the maintenance of the airtight state of the space. The X-ray transmission assembly 20 may further comprises a spacer 30.

According to the X-ray tube 1 and the method of manufacturing the same of the fourth embodiment of the above-described structure, the X-ray tube 1 comprises the envelope 17 comprising the opening 17*w*, the X-ray transmission assembly 20, the cathode 18 and the anode target 10. The sealing member 25 may comprise the rubber seal member 27 and the pressurization member 28, with which also an effect similar to that of the third embodiment can be obtained.

Further, when manufacturing the X-ray transmission assembly 20, the X-ray-resistive resin film 23 is mounted in advance to the frame member 24 to form an integrated unit. In this manner, the X-ray-resistive resin film 23 can be easily handled. Therefore, the X-ray transmission assembly 20 can be even more easily formed.

As described above, the X-ray tube 1 and the method of manufacturing the same can be obtained, which can prolong the product life cycle and achieve excellent reliability.

Next, an X-ray tube and a method of manufacturing the same, of the fifth embodiment will now be described in detail. In this embodiment, the structural members other than those which will be particularly discussed are identical to those of the fourth embodiment, and therefore they are designated by the same reference numbers and the detailed descriptions therefor will be omitted. Further, the method of manufacturing the X-ray tube is the same as that of the fourth embodiment.

Figure 10:
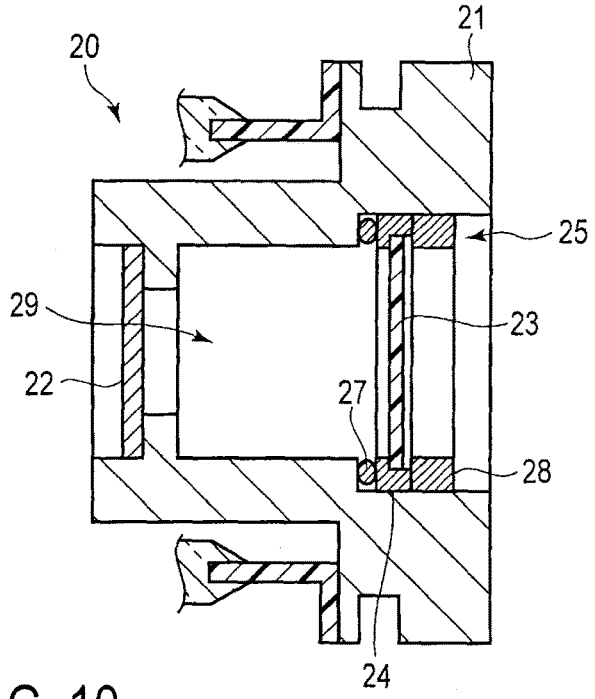
FIG. 10 is an enlarged cross-sectional view showing an X-ray transmission assembly of an X-ray tube of the fifth embodiment.
Figure 11:
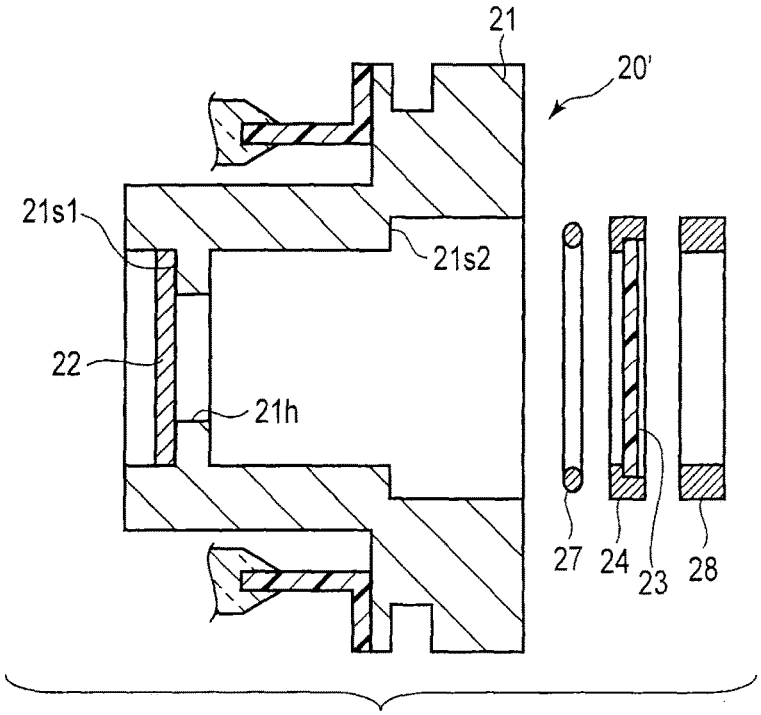
FIG. 11 is a decomposed diagram of the X-ray transmission assembly shown in FIG. 10, illustrating a window frame, an X-ray transmission window, an X-ray-resistive resin film, a rubber sealing member and a pressurization member.

As shown in FIGS. 10 and 11, a frame member 24 comprises a step portion formed therein. With this structure, an end face of the frame member 24 is formed to protrude over the surface of an X-ray-resistive resin film 23 the pressurization member 28 side. Therefore, the function of the pressurization member 28 can be exhibited without contacting the X-ray-resistive resin film 23 (pressurizing the X-ray-resistive resin film 23).

In this embodiment also, a sealing member 25 may comprise a reinforcing member such as described above to reinforce the maintenance of the airtight state of the space.

According to the X-ray tube 1 and the method of manufacturing the same of the fifth embodiment of the above-described structure, the X-ray tube 1 comprises the envelope 17 comprising the opening 17*w*, the X-ray transmission assembly 20, the cathode 18 and the anode target 10. With this structure, an effect similar to that of the fourth embodiment described above can be obtained. Further, with the step portion formed in the frame member 24, the function of the pressurization member 28 can be exhibited without having the pressurization member 28 contact the X-ray-resistive resin film 23.

As described above, the X-ray tube 1 and the method of manufacturing the same can be obtained, which can prolong the product life cycle and achieve excellent reliability.

Next, an X-ray tube of a comparative example will now be described.

Figure 12:
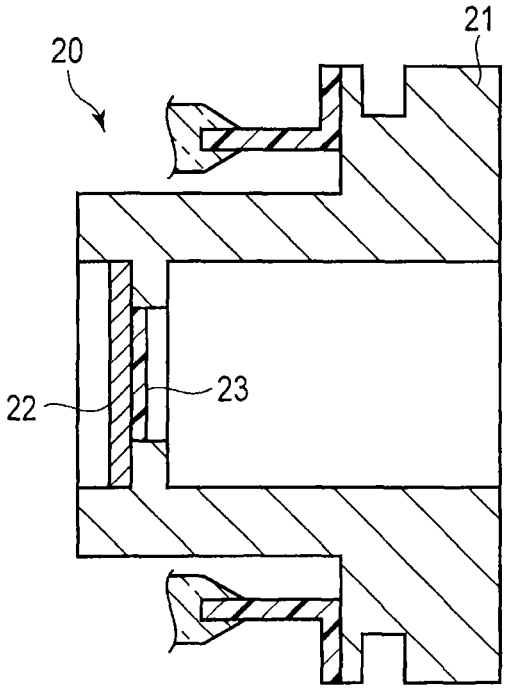
FIG. 12 is an enlarged cross-sectional view showing an X-ray transmission assembly of an X-ray tube of a comparative example.

As shown in FIG. 12, an X-ray transmission assembly 20 of an X-ray tube 1 of the comparative example does not comprise a space filled with a dry gas 29 such as described above. An X-ray-resistive resin film 23 is a coating film, and formed by applying a PI resin-forming liquid on an X-ray transmission window 22 while it is fit in a window frame 21, and drying and baking the PI resin-forming liquid.

In the X-ray transmission assembly 20 of the X-ray tube 1 of the comparative example described above, acids produced on the outer surface of the X-ray-resistive resin film 23 gradually diffuses and penetrate in the X-ray-resistive resin film 23 and eventually cause corrosion on the X-ray transmission window 22 tightly attached to the opposite surface of the X-ray-resistive resin film 23.

But the diffusion and penetration of acids take time, and therefore it may be possible to obtain an effect of delaying the time of the occurrence of failures in comparison with the case where a coating film (X-ray-resistive resin film 23) is not formed. With the structure of the comparative example, however, the corrosion of the X-ray transmission window 22 eventually occurs. Thus, the comparative example is inferior to the above-described embodiments in effect.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

In the above-describe embodiments, the dry gas 29, for example, is not limited to an inert gas, but replaced by various types of gases. For example, dry air can be used as the dry gas 29.

The sealing member 25 may comprise a fusion joint portion formed through fusion of the X-ray-resistive resin film 23. For example, when an X-ray-resistive resin film 23 made of PEEK resin, which is a thermoplastic resin, is used, it is possible to apply a laser beam to the mount region of the X-ray-resistive resin film 23 to fuse and adhere to the second mount surface 21*s*2 (window frame 21).

When the sealing member 25 comprises a joint portion made by the above described fusion process, the sealing member 25 may further comprise a reinforcing member such as described above. As described above, as the reinforcing member, adhesive, sealing agent, coating film or the like can be used.

The X-ray tube 1 is not limited to the stationary anode X-ray tube, but may be of a rotating-anode X-ray tube, also with which the above-described effect can be obtained. When a rotating-anode X-ray tube is used, it is used in combination with a stator coil (rotational drive mechanism) or the like which produces a magnetic field.

What is claimed is:

1. A stationary anode X-ray tube for X-ray analysis comprising:

an envelope comprising an opening;

an X-ray transmission assembly mounted on the envelope and vacuum-tightly blocking the opening;

a cathode accommodated in the envelope and configured to emit electrons; and an anode target accommodated in the envelope and configured to emit X-rays, wherein the X-ray transmission assembly comprises, a window frame opposing the opening and vacuum-tightly mounted to the envelope, an X-ray transmission window formed of a beryllium thin plate, accommodated in the window frame, and configured to maintain, along with the window frame, a vacuum-tight state inside the envelope and transmit X-rays, an X-ray-resistive resin film located in the atmosphere side from the window frame, opposing the X-ray transmission window with a gap between the X-ray-resistive resin film and window frame, and configured to form a space inside along with the window frame and the X-ray transmission window, a sealing member configured to air-tightly block the gap between the window frame and the X-ray-resistive resin film to maintain an airtight state of the space, and a dry gas which is filled in the space and does not contain moisture.

2. The stationary anode X-ray tube of claim 1, wherein the sealing member comprises a rubber sealing member provided between the window frame and the X-ray-resistive resin film, and a pressurization member configured to maintain a state that the X-ray-resistive resin film is pressurized onto the window frame via the rubber sealing member.

3. The stationary anode X-ray tube of claim 1, wherein the dry gas is an inert gas containing at least one of nitrogen, neon, argon, krypton and xenon.

4. The stationary anode X-ray tube of claim 1, wherein the sealing member comprises at least one of an adhesive joint portion which utilizes fusion of the X-ray-resistive resin film.

5. The stationary anode X-ray tube of claim 1, wherein the X-ray-resistive resin film is formed of polyetheretherketone (PEEK) or polyimide (PI).

6. A stationary anode X-ray tube for X-ray analysis comprising:

an envelope comprising an opening;

an X-ray transmission assembly mounted on the envelope and vacuum-tightly blocking the opening;

a cathode accommodated in the envelope and configured to emit electrons; and an anode target accommodated in the envelope and configured to emit X-rays, wherein the X-ray transmission assembly comprises, a window frame opposing the opening and vacuum-tightly mounted to the envelope, an X-ray transmission window formed of a beryllium thin plate, accommodated in the window frame, and configured to maintain, along with the window frame, a vacuum-tight state inside the envelope and transmit X-rays, an X-ray-resistive resin film located in the atmosphere side from the X-ray transmission window, opposing the X-ray transmission window with a gap between the X-ray-resistive resin film and the X-ray transmission window, a frame member opposing the opening, provided with the X-ray-resistive resin film air-tightly attached on the frame member, and configured to form a space inside along with the window frame, the X-ray transmission window and the X-ray-resistive resin film, a sealing member configured to air-tightly block the gap between the window frame and the frame member to maintain an airtight state of the space, and a dry gas which is filled in the space and does not contain moisture.

7. The stationary anode X-ray tube of claim 6, wherein the sealing member comprises a rubber sealing member provided between the window frame and the frame member, and a pressurization member configured to maintain a state that the frame member is pressurized onto the window frame via the rubber sealing member.

8. The stationary anode X-ray tube of claim 6, wherein the dry gas is an inert gas containing at least one of nitrogen, neon, argon, krypton and xenon.

9. The stationary anode X-ray tube of claim 6, wherein the sealing member comprises at least one of an adhesive joint portion which utilizes fusion of the X-ray-resistive resin film.

10. The stationary anode X-ray tube of claim 6, wherein the X-ray-resistive resin film is formed of polyetheretherketone (PEEK) or polyimide (PI).

11. A method of manufacturing a stationary anode X-ray tube for X-ray analysis, comprising:

preparing an envelope comprising an opening, a window frame, an X-ray transmission window formed of a beryllium thin plate, to transmit X-rays, a cathode to emit electrons, an anode target to emit X-rays, and an X-ray-resistive resin film;

accommodating the X-ray transmission window in the window frame;

mounting the window frame onto the envelope while the window frame in which the X-ray transmission window is accommodated opposing the opening, thereby vacuum-tightly blocking the opening;

accommodating the cathode and the anode target in the envelope;

evacuating internal space of the envelope in which the cathode and the anode target are accommodated and to which the window frame accommodating the X-ray transmission window therein is mounted, and vacuum-tightly sealing the envelope;

setting the X-ray-resistive resin film to locate an outer side of the envelope and to oppose the X-ray transmission window with a gap between the X-ray-resistive resin film and the X-ray transmission window in a dry gas atmosphere that does not contain moisture, thereby forming a space filled with a dry gas and defined by the window frame, the X-ray transmission window and the X-ray-resistive resin film; and air-tightly blocking the gap between the window frame and the X-ray-resistive resin film with a sealing member to maintain an airtight state of the space, thereby forming an X-ray transmission assembly comprising the window frame, the X-ray transmission window, the X-ray-resistive resin film, the sealing member and the dry gas.

12. The method of claim 11, wherein, maintaining the airtight state of the space with the sealing member comprises:

providing a rubber sealing member of the sealing member between the window frame and the X-ray-resistive resin film, and maintaining the X-ray-resistive resin film using a pressurization member of the sealing member in a state that the X-ray-resistive resin film is pressurized on the window frame via the rubber sealing member.

13. The method of claim 11, wherein the dry gas is an inert gas containing at least one of nitrogen, neon, argon, krypton and xenon.

14. The method of claim 11, wherein the sealing member comprises at least one of an adhesive joint portion which utilizes fusion of the X-ray-resistive resin film.

15. The method of claim 11, wherein the X-ray-resistive resin film is formed of polyetheretherketone (PEEK) or polyimide (PI).

16. A method of manufacturing a stationary anode X-ray tube for X-ray analysis, comprising:

preparing an envelope comprising an opening, a window frame, an X-ray transmission window formed of a beryllium thin plate, to transmit X-rays, a cathode to emit electrons, an anode target to emit X-rays, a frame member and an X-ray-resistive resin film;

accommodating the X-ray transmission window in the window frame;

mounting the window frame onto the envelope while the window frame in which the X-ray transmission window is accommodated opposing the opening, thereby vacuum-tightly blocking the opening;

accommodating the cathode and the anode target in the envelope;

evacuating internal space of the envelope in which the cathode and the anode target are accommodated and to which the window frame accommodating the X-ray transmission window therein is mounted, and vacuum-tightly sealing the envelope;

air-tightly attaching the X-ray-resistive resin film to the frame member;

setting the X-ray-resistive resin film to oppose the X-ray transmission window with a gap between the X-ray-resistive resin film and the X-ray transmission window while the frame member opposing the opening in an outer side of the envelope in a dry gas atmosphere that does not contain moisture, thereby forming a space filled with a dry gas and defined by the window frame, the X-ray transmission window, the X-ray-resistive resin film and the frame member; and air-tightly blocking the gap between the window frame and the frame member with a sealing member to maintain an airtight state of the space, thereby forming an X-ray transmission assembly comprising the window frame, the X-ray transmission window, the frame member, the X-ray-resistive resin film, the sealing member and the dry gas.

17. The method of claim 16, wherein, maintaining the airtight state of the space with the sealing member comprises:

providing a rubber sealing member of the sealing member between the window frame and the frame member, and maintaining the frame member using a pressurization member of the sealing member in a state that the frame member is pressurized on the window frame via the rubber sealing member.

18. The method of claim 16, wherein the dry gas is an inert gas containing at least one of nitrogen, neon, argon, krypton and xenon.

19. The method of claim 16, wherein the sealing member comprises at least one of an adhesive joint portion which utilizes fusion of the X-ray-resistive resin film.

20. The method of claim 16, wherein the X-ray-resistive resin film is formed of polyetheretherketone (PEEK) or polyimide (PI).

* * * * *